US008458819B1

(12) United States Patent
Hoole

(10) Patent No.: US 8,458,819 B1
(45) Date of Patent: Jun. 11, 2013

(54) UNDERGARMENT WITH POWDER DISPENSER AND METHOD OF USE

(76) Inventor: Richard J. Hoole, New Smyrna Beach, FL (US)

( * ) Notice: Subject to any disclaimer, the term of this patent is extended or adjusted under 35 U.S.C. 154(b) by 332 days.

(21) Appl. No.: 12/798,459

(22) Filed: Apr. 6, 2010

(51) Int. Cl.
*A41B 9/02* (2006.01)

(52) U.S. Cl.
USPC ..... 2/403; 2/400; 2/401; 2/407; 2/247; 450/150

(58) Field of Classification Search
USPC ..... 2/400–409, 238, 78.1–78.3, 79, 227, 2/228, 53–55, 57, 58, 247–248, 250, 253–254; 450/150, 100–105, 94, 117, 148, 153; 401/7
See application file for complete search history.

(56) References Cited

U.S. PATENT DOCUMENTS

| | | | | | |
|---|---|---|---|---|---|
| 352,297 | A | * | 11/1886 | Cohlman | 2/227 |
| 1,018,912 | A | * | 2/1912 | Kaschewski | 2/253 |
| 1,146,685 | A | * | 7/1915 | Bernstein | 2/253 |
| 1,161,435 | A | * | 11/1915 | Baker | 2/253 |
| 1,176,865 | A | * | 3/1916 | Skaren | 2/250 |
| 1,239,888 | A | * | 9/1917 | Cook | 2/254 |
| 1,255,497 | A | * | 2/1918 | Ankele | 2/254 |
| 2,375,652 | A | * | 5/1945 | Hess | 2/253 |
| 2,391,641 | A | * | 12/1945 | O'Hern | 2/407 |
| 2,604,627 | A | * | 7/1952 | Abbott | 2/115 |
| 2,654,093 | A | * | 10/1953 | Geissmann | 2/80 |
| 3,871,030 | A | | 3/1975 | Green | |
| 4,852,188 | A | | 8/1989 | Marsh et al. | |
| 4,913,896 | A | * | 4/1990 | Harvey | 424/69 |
| 4,977,626 | A | | 12/1990 | Keen et al. | |
| 5,067,178 | A | | 11/1991 | Katchka | |
| 5,496,205 | A | | 3/1996 | Lee | |
| 5,716,255 | A | * | 2/1998 | Abercrombie et al. | 450/60 |
| 5,823,432 | A | * | 10/1998 | Hogan | 239/36 |

(Continued)

FOREIGN PATENT DOCUMENTS

| | | | |
|---|---|---|---|
| CN | 2917321 | * | 4/2007 |
| CN | 101254031 | * | 3/2008 |

OTHER PUBLICATIONS

Hegenbart, Scott, Understanding Starch Functionality, Jan. 1996, http://www.foodproductdesign.com/articles/1996/01/understanding-starch-functionality.aspx, p. 1.*

(Continued)

*Primary Examiner* — Khoa Huynh
*Assistant Examiner* — Brieanna Fuller
(74) *Attorney, Agent, or Firm* — Paul S. Rooy

(57) ABSTRACT

An undergarment with powder dispenser and method of use. A powder dispenser is attached to an undergarment torso rear. Powder is placed within the powder dispenser and diffuses through a powder-permeable powder dispenser front wall onto the skin of a user wearing the undergarment with powder dispenser. The powder dispenser extends downwards from an undergarment torso waist substantially 80% of the way to an undergarment crotch. A powder dispenser rear wall top edge elastic keeps powder within the powder dispenser from escaping. Downwardly-sloping powder dispenser baffles extend alternatingly from powder dispenser rear wall side edges, creating a serpentine powder path to improve powder distribution. Method of use steps include inserting anti-chaffing powder through a powder dispenser mouth and into a powder dispenser reservoir, and then allowing it to diffuse through the powder dispenser front wall onto the wearer, thus helping avoid skin irritation in the buttock, crotch, and thigh areas.

3 Claims, 4 Drawing Sheets

U.S. PATENT DOCUMENTS

| | | | | |
|---|---|---|---|---|
| 5,870,777 | A * | 2/1999 | Hans | 2/238 |
| 6,018,823 | A * | 2/2000 | Ortmeier | 2/406 |
| 6,023,789 | A * | 2/2000 | Wilson et al. | 2/228 |
| 6,076,195 | A * | 6/2000 | Klein | 2/400 |
| 6,477,710 | B1 | 11/2002 | Ojoyeyi | |
| 6,639,119 | B2 * | 10/2003 | Roe et al. | 604/367 |
| 2004/0060091 | A1 * | 4/2004 | Katz | 2/48 |
| 2004/0082927 | A1 | 4/2004 | Littleton et al. | |
| 2006/0191059 | A1 * | 8/2006 | Smith | 2/400 |
| 2008/0021420 | A1 | 1/2008 | Littleton et al. | |
| 2009/0025124 | A1 | 1/2009 | Gearhart | |
| 2009/0053274 | A1 | 2/2009 | Thomson | |
| 2009/0264849 | A1 * | 10/2009 | La Croix | 604/385.06 |
| 2009/0270829 | A1 * | 10/2009 | Hameed et al. | 604/385.06 |
| 2010/0298914 | A1 * | 11/2010 | Rosenbaum | 607/108 |

OTHER PUBLICATIONS

The backpacker, Crotch Rot, Jun. 2007, http://www.thebackpacker.com/trailtalk/thread/48477.php, pp. 1-9.* fibre2fashion., Interview—Mr. Jan Rosenberg, Head of Global Marketing & Sales, Triumph International Ltd, Jul. 2008, http://www.fibre2fashion.com/face2face/jan-rosenberg/triumph-international-ltd.asp.*

* cited by examiner

UNDERGARMENT WITH POWDER DISPENSER AND METHOD OF USE

BACKGROUND OF THE INVENTION

1. Field of the Invention

This invention relates to powder dispensing, and in particular to an Undergarment With Powder Dispenser and Method of Use.

2. Background of the Invention

A frequently-occurring problem associated with perspiring, whether the perspiration is caused by strenuous exercise, heat, work, or other reason, is an irritation which can be located in the buttock, crotch or thigh area of the afflicted person. This irritation may manifest itself as an itchy rash, gald, raw area, chafing, or "jock itch" (*Tinea cruris*). These conditions cause discomfit in the form of itching, irritation, and painfulness, and in extreme cases infection can result from excessive scratching.

The best way to avoid these symptoms lies in prevention. Prevention of irritation may be accomplished by keeping potentially-afflicted areas clean and dry, and application of an anti-chaffing/drying agent such as baby powder, talcum powder, corn starch, or commercially-available powders containing menthol or zinc oxide. Thus, it would be desirable to provide an apparatus for metering out anti-chaffing powder to potentially-afflicted areas over a period of time, such as the duration period of an exercise routine or the work being performed. It would be further desirable to manufacture such powder-dispensing apparatus integral with an article of clothing worn by the exerciser or worker, for maximum convenience.

It would also be desirable to provide a powder-dispensing apparatus wherein the powder it contains does not bunch up at it's lowest point.

Existing Designs.

US publication Nos. 2008/0021420 and 2004/0082927, both by Littleton et al., disclosed a pocket or envelope capable of dispensing powder, intended to be inserted into the fly of mens underwear. This design suffered from a number of problems. First, the pouch could fall out of the fly, or in the alternative, into the inside of the underwear, thus causing discomfit, loss, and inefficiency in dispensing its contents. In addition, under these circumstances, the location of application of the powder could be erroneous due to the unintended movement of the pouch.

Another problem associated with this design is the absence of provision to slow the movement of powder in the pouch, which could lead to bunching together of powder at the lowest point of the pouch.

Similarly, US publication No. 2009/0053274 by Thomson disclosed a pouch which could be located on clothing. A problem associated with this design is the absence of provision to slow the movement of powder in the pouch, which could lead to bunching together of powder at the lowest point of the pouch.

A number of disclosures and patents taught pockets in clothing appropriate to receive various items. Representative of these are U.S. Pat. Nos. 2009/0025124, 6,477,710, 5,496,205, 5,067,178, 4,977,626, 4,852,188, and 3,871,030 by Gearhart, Ojoyeyi, Lee, Katchka, Smith, Marsh et al., and Green. While these taught clothing-mounted pockets intended to contain weights, medical appliances, valuables, condoms, food-wrapping sheets, valuables, and tennis balls respectively, they disclosed no apparatus and/or method to dispense powder.

SUMMARY OF THE INVENTION

Accordingly, it is an object of this invention to provide an undergarment with powder dispenser and method of use which dispenses powder to the user directly to the best dispensation site. Design features enabling the accomplishment of this object include a powder dispenser disposed on an undergarment back, extending downwards from an undergarment elastic waist. Advantages associated with the realization of this object include the ability to dispense powder at the most strategic site, and consequent wearer relief from irritation.

It is another object of this invention to provide an undergarment with powder dispenser which provides means to avoid all the powder bunching up at its bottom. Design features enabling the accomplishment of this object include a powder dispenser serpentine path extending from a powder dispenser mouth, around powder dispenser baffles, and to a powder dispenser bottom edge. Advantages associated with the realization of this object include improved efficiency of powder dispensing, because the powder is spread out over a greater area, as opposed to being all bunched up at the bottom of the powder dispenser, and consequent improved wearer relief from irritation.

It is yet another object of this invention to provide an undergarment with powder dispenser which tends to hold powder within its reservoir, without spilling out of its mouth. Design features allowing this object to be achieved include a powder dispenser reservoir having a powder dispenser top edge elastic disposed along a powder dispenser rear wall top edge. Benefits associated with reaching this objective include decreased powder spillage, and thus greater facility of use.

It is another object of the present invention to provide an undergarment with powder dispenser method of use which provides for metered dispensing of powder to a predetermined area on an undergarment back extending downwards from an undergarment elastic waist. Method steps allowing this object to be accomplished include introducing powder into a powder dispenser reservoir; a user wearing the undergarment with powder dispenser; and permitting the powder to diffuse through the powder dispenser front wall onto the wearer's skin. Advantages associated with the accomplishment of this object include reduced wearer irritation, and increased wearer comfort.

It is still another object of the present invention to provide an undergarment with powder dispenser method of use which provides for avoidance of powder "bunching up" at the bottom of the reservoir. Method steps allowing this object to be accomplished include providing a plurality of powder dispenser baffles in a powder dispenser reservoir; and permitting powder to distribute itself throughout the powder dispenser reservoir following a serpentine path defined by the baffles. Advantages associated with the accomplishment of this object include more efficient and wider-spread distribution of powder to the wearer, and consequent reduced wearer irritation and increased wearer comfort.

It is yet another object of this invention to provide an undergarment with powder dispenser which is inexpensive to manufacture. Design features allowing this object to be achieved include the use of components made of readily available materials, and the use of existing manufacturing techniques. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Three sheets of drawings are provided. Sheet one contains FIG. 1. Sheet two contains FIG. 2. Sheet three contains FIG. 3.

DETAILED DESCRIPTION OF THE PREFERRED EMBODIMENT

Figure 1:
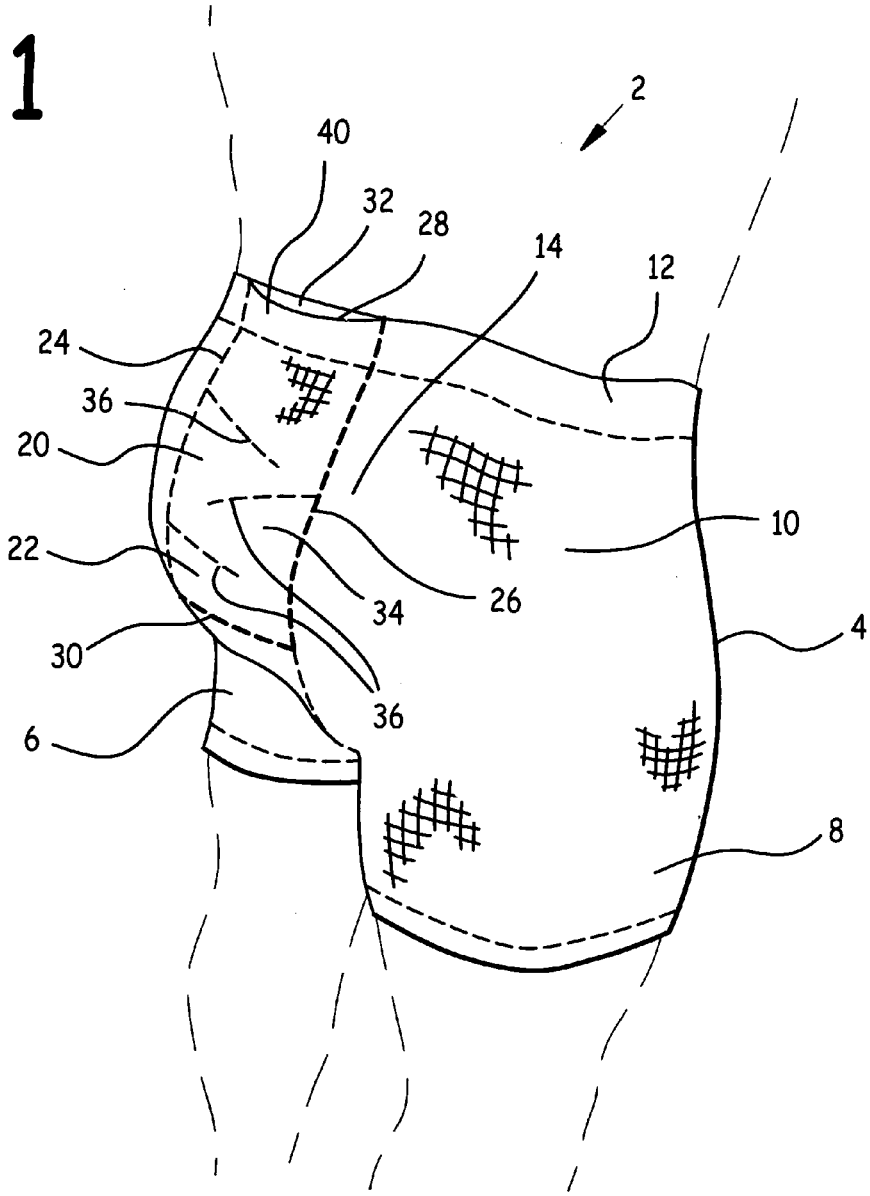
FIG. 1 is a rear quarter side isometric view of an undergarment with powder dispenser.
Figure 2:
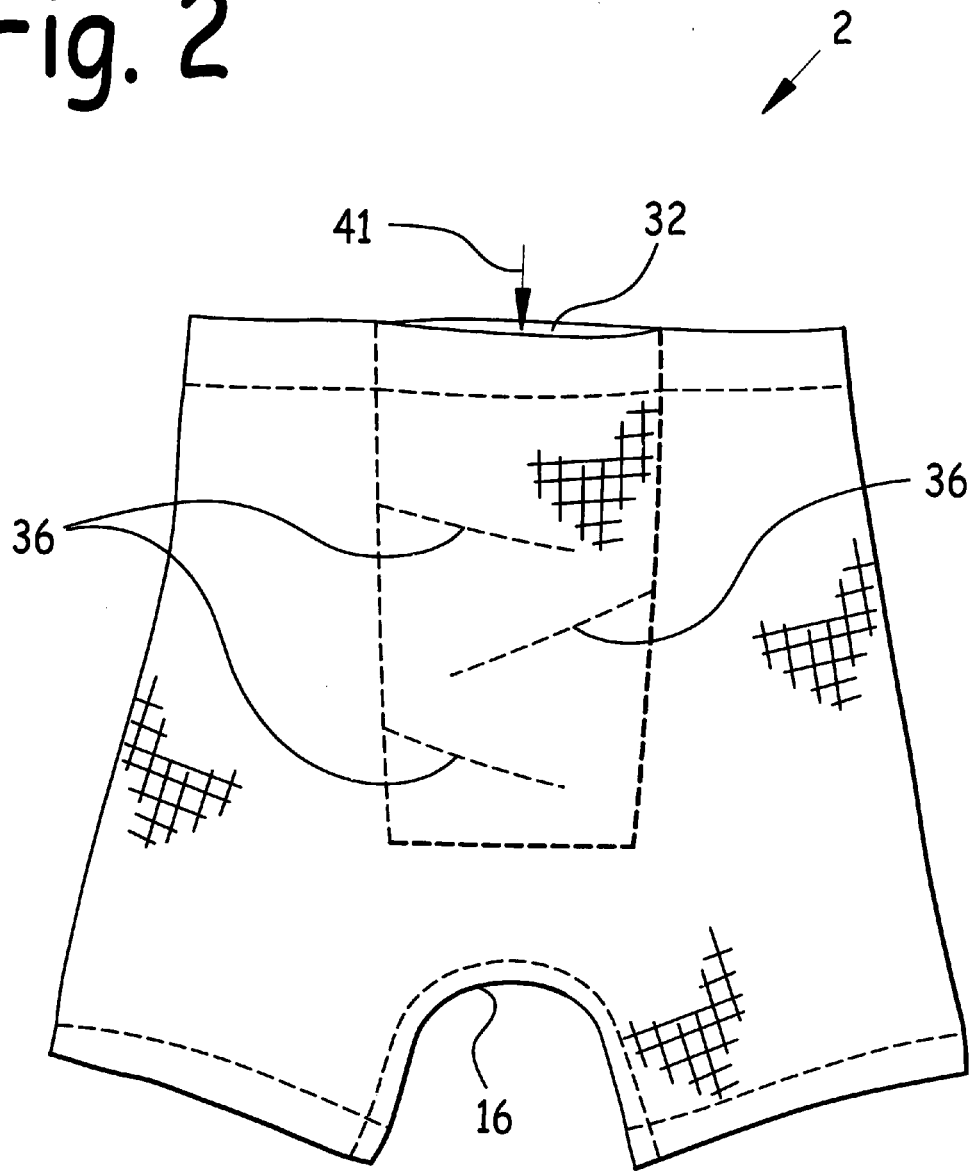
FIG. 2 is a rear view of an undergarment with powder dispenser.

FIG. 1 is a rear quarter side isometric view of undergarment with powder dispenser 2. FIG. 2 is a rear view of undergarment with powder dispenser 2. As may be observed in these figures, undergarment with powder dispenser 2 comprises undergarment 4 with powder dispenser 20 attached to its undergarment back 14.

Undergarment 4 is an existing undergarment comprising undergarment torso 10 sized to fit around a human torso in conventional fashion, having undergarment back 14. Undergarment 4 is made of breathable, powder-permeable material such as cotton.

The undergarment 4 depicted in the figures is of a "boxer shorts" configuration, further comprising undergarment first leg 6 and undergarment second leg 8 attached to the lower edge of undergarment torso 10, and undergarment elastic waist 12 disposed around the upper edge of undergarment torso 10. Although the figures depict undergarment 4 as a pair of "boxer shorts", it is intended to be within the scope of this disclosure that undergarment 4 be any configuration undergarment, including briefs, bikini style bottoms, etc.

Powder dispenser 20 is centrally mounted on undergarment back 14, and extends from the top edge of undergarment torso 10 downwards substantially 80%±10% of the way to undergarment crotch 16.

Figure 3:
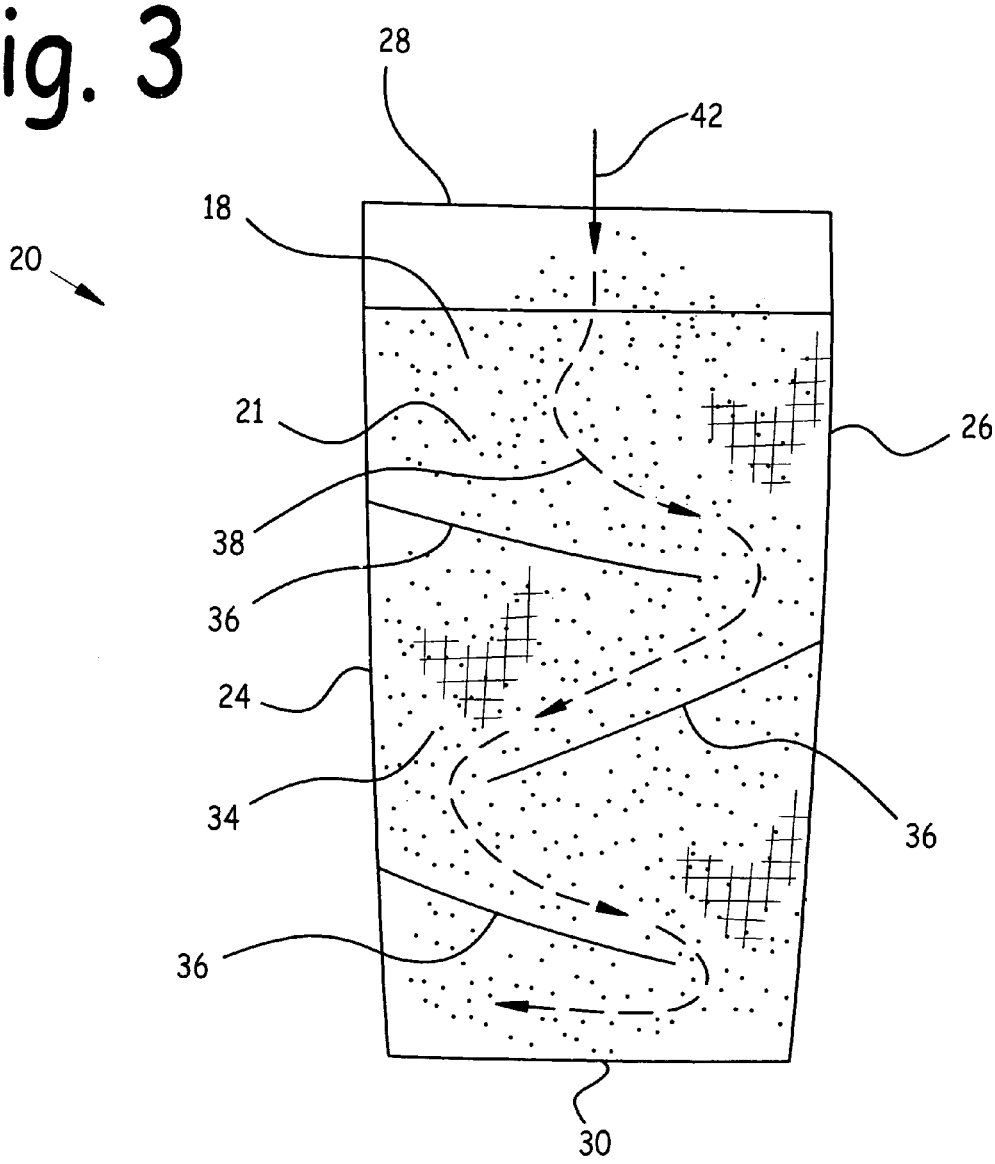
FIG. 3 is a rear cross-sectional view of a powder dispenser.

Referring now also to FIG. 3, a rear cross-sectional view of powder dispenser 20, it may be observed that powder dispenser 20 comprises powder dispenser front wall 21 attached to powder dispenser rear wall 22 at powder dispenser first side edge 24, powder dispenser second side edge 26, and powder dispenser bottom edge 30. In the preferred embodiment, powder dispenser front wall 21 was simply part of undergarment back 14, and powder dispenser rear wall 22 was a piece of fabric attached along its side edges and bottom to undergarment back 14 with stitches.

Because powder dispenser front wall 21 is attached to powder dispenser rear wall 22 at powder dispenser first side edge 24, powder dispenser second side edge 26, and powder dispenser bottom edge 30, powder dispenser top edge is not attached to undergarment 4, and together with undergarment 4 and powder dispenser rear wall top edge 28, forms powder dispenser mouth 32.

The space between powder dispenser front wall 21 and powder dispenser rear wall 22 is powder dispenser reservoir 34, which communicates with the exterior of powder dispenser 20 through powder dispenser mouth 32. Thus, powder dispenser reservoir 34 is bounded by powder dispenser front wall 21, powder dispenser rear wall 22, powder dispenser first side edge 24, powder dispenser second side edge 26, and powder dispenser bottom edge 30.

Powder dispenser 4 may further comprise powder dispenser rear wall top edge elastic 40 disposed along powder dispenser rear wall top edge 28. Powder dispenser rear wall top edge elastic 40 serves to hold powder dispenser rear wall top edge 28 flat against undergarment elastic waist 12, thus urging powder dispenser mouth 32 into a closed position, so as to keep powder 18 contained in powder dispenser reservoir 34 within powder dispenser reservoir 34. In the preferred embodiment, powder dispenser rear wall top edge elastic 40 overlaid undergarment elastic waist 12.

If powder 18 were to simply be poured through powder dispenser mouth 32 into powder dispenser reservoir 34 as indicated by arrow 41 in FIG. 2 and arrow 42 in FIG. 3, the powder would fall directly into the bottom of powder dispenser 20 under the influence of gravity and form a lump there, drastically reducing the efficiency of diffusing powder 18 through powder dispenser front wall 21, and preventing the effective spread of powder 18 over the affected area.

Figure 4:
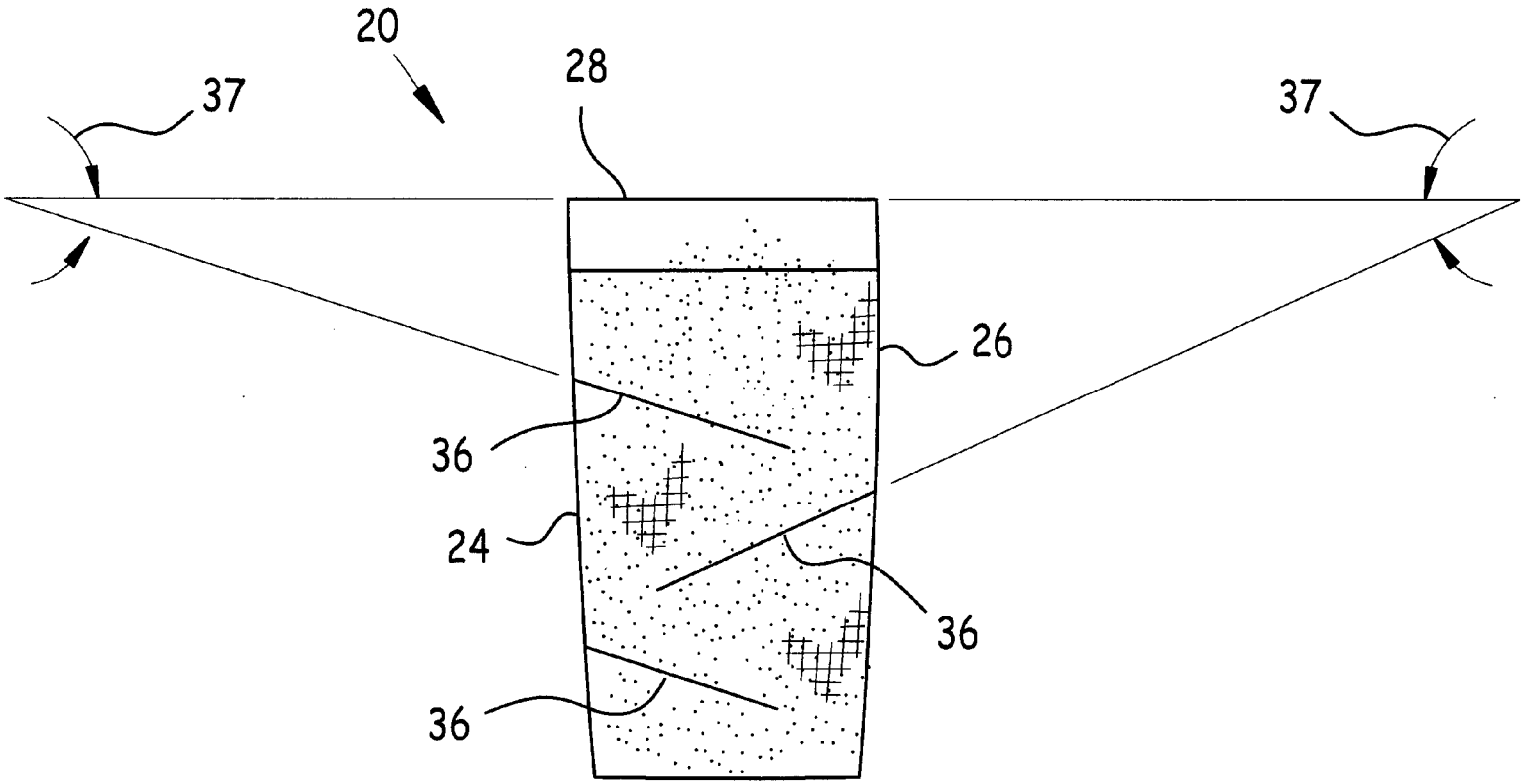
FIG. 4 is a rear cross-sectional view of a powder dispenser depicting the powder dispenser baffle angle.

Therefore, a series of downwardly-sloping powder dispenser baffles 36 are incorporated into powder dispenser reservoir 34, so as to slow the descent of powder 18, and to spread powder 18 across the reach of powder dispenser 4. Each powder dispenser baffle 36 slopes downwards from its point of origin on a respective powder dispenser edge 24 or 26 at a powder dispenser baffle angle 37 substantially equal to 20°±10° relative to powder dispenser rear wall top edge 28, as is depicted in FIG. 4.

Powder dispenser baffles 36 extend alternatingly from powder dispenser first side edge 24 and powder dispenser second side edge 26, thus forming serpentine path 38 within powder dispenser reservoir 34, as depicted in FIG. 3. Serpentine path 38 directs powder 18 gradually through the reach of powder dispenser 20, thus gradually spreading powder 18 across the reach of powder dispenser 4, and maximizing the area through which powder 18 diffuses through powder dispenser front wall 21 and onto the skin of the wearer. In the preferred embodiment, powder dispenser baffles 36 were lines of stitching attaching powder dispenser front wall extending 70%±10% across the width of powder dispenser 4.

Although the figures depict powder dispenser front wall 21 as being a section of undergarment back 14, it is intended to fall within the scope of this disclosure that powder dispenser 20 be an independent component, having its own powder dispenser rear wall 22 attached to a powder dispenser front wall 21, and that powder dispenser 20 may then be attached to undergarment back 14 using stitches or other appropriate means. In such embodiment, powder 18 within powder dispenser 20 would diffuse through powder dispenser front wall 21 and undergarment back 14 in order to reach a user wearing undergarment with powder dispenser 2.

In use, an anti-chaffing/drying powder 18 such as baby powder, talcum powder, corn starch, or commercially-available powders containing menthol or zinc oxide is introduced through powder dispenser mouth 32 into powder dispenser reservoir 34, as indicated by arrow 42 in FIG. 3. This may be accomplished either before the user dons undergarment with powder dispenser 2, or while the user is wearing undergarment with powder dispenser 2. Powders of this type are frequently sized in the 15 micron±10 micron range. An appropriate amount of powder added in this fashion may be around a tablespoon full, and may last from a few hours to all day, depending on the specific thread count in powder dispenser front wall 21, the particle size of the powder used, etc.

Powder 18 gradually distributes itself under the influence of gravity following serpentine path 38 in FIG. 3. Over time, powder 18 becomes distributed throughout powder dispenser reservoir 34, and thence diffuses through the permeable fabric of powder dispenser front 21, where it acts on the skin of the user.

After the powder 18 contained in powder dispenser 20 is used up, the above steps may be repeated to replenish the powder 18 in powder dispenser reservoir 34, where powder 18 once again distributes itself throughout powder dispenser reservoir 34, and thence diffuses through the permeable fabric of powder dispenser front 21 to benefit the skin of the user. Fabric used for undergarments are frequently of the 150±100 thread per inch weave count.

In the preferred embodiment, undergarment 4 and powder dispenser 20 were made of permeable material such as cotton, nylon/cotton blend, or other appropriate fabric used in the manufacture of undergarments. Undergarment elastic waist 12 and powder dispenser rear wall top edge elastic 40 were made of apparel elastic used in the manufacture of undergarments and other garments. Powder 18 was an anti-chaffing/drying agent such as baby powder, talcum powder, corn starch, commercially-available powders containing menthol or zinc oxide, or other appropriate irritation-relief powder.

While a preferred embodiment of the invention has been illustrated herein, it is to be understood that changes and variations may be made by those skilled in the art without departing from the spirit of the appending claims.

DRAWING ITEM INDEX

2 undergarment with powder dispenser
4 undergarment
6 undergarment first leg
8 undergarment second leg
10 undergarment torso
12 undergarment elastic waist
14 undergarment back
16 undergarment crotch
18 powder
20 powder dispenser
21 powder dispenser front wall
22 powder dispenser rear wall
24 powder dispenser first side edge
26 powder dispenser second side edge
28 powder dispenser rear wall top edge
30 powder dispenser bottom edge
32 powder dispenser mouth
34 powder dispenser reservoir
36 powder dispenser baffle
37 powder dispenser baffle angle
38 powder dispenser serpentine path
40 powder dispenser rear wall top edge elastic
41 arrow
42 arrow

I claim:

1. An undergarment for encircling a lower torso of the wearer, said undergarment comprising:

a powder dispenser, and powder in said powder dispenser;

said undergarment comprising an undergarment torso having an undergarment back;

said powder dispenser being attached to said undergarment back;

said powder dispenser comprising a powder dispenser rear wall and a powder dispenser front wall;

said powder dispenser rear wall being attached to said powder dispenser front wall along a powder dispenser first side edge, a powder dispenser second side edge, and a powder dispenser bottom edge;

said powder dispenser front wall being made of a powder-permeable material;

a powder dispenser mouth bounded by a powder dispenser rear wall top edge and an upper edge of said powder dispenser front wall;

a powder dispenser reservoir bounded by said powder dispenser front wall, said powder dispenser rear wall, said powder dispenser first side edge, said powder dispenser second side edge, and said powder dispenser bottom edge;

said powder dispenser reservoir communicating with an exterior of said powder dispenser through said powder dispenser mouth; and a plurality of powder dispenser baffles extending downwards from edges of said powder dispenser front wall, each said powder dispenser baffle extending between said powder dispenser front wall and said powder dispenser rear wall, each said powder dispenser baffle extending only partially across said powder dispenser reservoir, said plurality of powder dispenser baffles extending alternatingly from opposite side edges of said powder dispenser, thereby providing a serpentine path for said powder through said powder dispenser reservoir wherein each said powder dispenser baffle extends downwards from an edge of said powder dispenser front wall at a powder dispenser baffle angle of 20°±10°, and each said powder dispenser baffle extends substantially 70%±10% across a width of said powder dispenser;

wherein said powder dispenser extends downwards from an undergarment upper edge substantially 80%±10% of a distance between said undergarment upper edge and a crotch of said undergarment;

wherein said undergarment further comprises an undergarment elastic waist around said upper edge of said powder dispenser front wall, and wherein said powder dispenser further comprises an undergarment rear wall top edge elastic disposed along said powder dispenser rear wall top edge, said undergarment rear wall top edge elastic substantially overlying said undergarment elastic waist creating said powder dispenser mouth for said powder to be inserted into said powder dispenser reservoir.

2. The undergarment of claim 1, wherein said powder is comprised of particles sized 15±10 microns.

3. The undergarment of claim 1, wherein said undergarment is made of fabric, said powder dispenser front wall is a section of said undergarment back, and said powder is baby powder, talcum powder, corn starch, or powder containing menthol or zinc oxide.

* * * * *